United States Patent [19]

Willis

[11] 4,144,706

[45] Mar. 20, 1979

[54] ALARM WATCH WITH REMOTE SONIC GENERATOR

[75] Inventor: Alan E. Willis, Stamford, Conn.

[73] Assignee: Timex Corporation, Waterbury, Conn.

[21] Appl. No.: 861,376

[22] Filed: Dec. 16, 1977

Related U.S. Application Data

[63] Continuation-in-part of Ser. No. 761,087, Jan. 21, 1977, abandoned.

[51] Int. Cl.[2] ..... G04B 23/12

[52] U.S. Cl. ..... 58/57.5; 58/152 B; 58/16 R; 58/16 D; 58/23 R

[58] Field of Search ..... 58/24 R, 26 R, 23 R, 58/23 BA, 16 R, 16 D, 57.5, 152 R, 152 B, 38 R; 200/35 R; 325/396; 340/224, 384 R, 309.1; 179/396

[56] References Cited

U.S. PATENT DOCUMENTS

| | | | |
|---|---|---|---|
| 327,919 | 10/1885 | Burmann | 58/57.5 |
| 1,361,413 | 12/1920 | Stenberg | 58/57.5 |
| 1,529,852 | 3/1925 | Tanglin | 58/57.5 |
| 2,721,611 | 10/1955 | Gordon | 200/35 R X |
| 2,899,674 | 8/1959 | Sierer | 340/224 X |
| 3,032,651 | 5/1962 | Gisiger-Stahli et al. | 58/152 B |
| 3,361,973 | 1/1968 | Wysong | 325/396 |
| 3,361,974 | 1/1968 | Wysong | 325/396 |
| 4,063,410 | 12/1977 | Welling | 58/57.5 X |

FOREIGN PATENT DOCUMENTS

| | | | |
|---|---|---|---|
| 546800 | 5/1932 | Fed. Rep. of Germany | 58/16 R |
| 2334969 | 1/1975 | Fed. Rep. of Germany | 58/16 R |
| 566896 | 9/1957 | Italy | 58/57.5 |

*Primary Examiner*—Ulysses Weldon
*Attorney, Agent, or Firm*—William Crutcher

[57] ABSTRACT

An alarm device comprises a wrist watch which includes timing and alarm setting elements with a separate alarm box containing a sensor and sonic generator alarm. When the alarm feature is to be used, the watch is mounted in the alarm box and at the time of alarm, the wristwatch provides electrically generated alarm coupling signals which are detected by the remote sensor to activate the sonic generator alarm. The electrically generated coupling signals may be RF, magnetic or optical. Since the sonic generator and associated power supply of the alarm are mounted in the alarm box, rather than in the watch, the alarm watch may be styled to provide an aesthetically attractive watch which is thin and of suitably small dimensions.

8 Claims, 8 Drawing Figures

ALARM WATCH WITH REMOTE SONIC GENERATOR

RELATED APPLICATIONS

This application is a continuation-in-part of application Ser. No. 761,087 filed Jan. 21, 1977, now abandoned.

BACKGROUND OF THE INVENTION

This invention relates to alarm watches and particularly to an alarm-actuating wrist watch having a remote sonic generator.

Electronic alarm watches which emit an audible signal at an adjustable predetermined time are well known in the art. In the case of wrist alarm watches, however, an unsatisfactory compromise between two conflicting design requirements had to be made, namely, styling considerations and functional considerations. The styling considerations dictate a small wrist watch which is relatively thin and the functional considerations require a sonic generator of adequate loudness with a relatively large power supply to activate the alarm generator.

In the present invention, the alarm is physically separated from the time keeping means, which by virtue of the advances in microelectronics, may be enclosed in a small watch case satisfying the aesthetic styling demands of the public. The sonic generator together with its power source and additional circuitry and sensor element are mounted in a separate larger enclosure which also serves as a stand for the wrist watch when used with its alarm feature. When the wrist watch indicates a pre-set time, alarm coupling signals are electrically generated by the watch. These are detected by the remote sensor element so that the sonic generator is activated from its own power source. The fact that the wrist watch cannot function as an alarm watch when worn on the wrist is not considered to be a serious drawback since alarms are mainly used in the morning and the user has customarily removed his watch at night and placed it in a convenient resting place. The invention provides such a resting place in the form of an alarm box which serves as a stand for the watch holding it in proximity to the sensing element and in a position that the time display can be seen by the user.

The prior art discloses a number of mechanical remote alarm systems which have little or no bearing upon the present invention. One early patent is U.S. Pat. No. 73,154 to Baum which issued Jan. 7, 1869. U.S. Pat. No. 327,919 to Burmann which issued Oct. 6, 1885 also discloses an early arrangement showing a watch stand alarm. Italian Pat. No. 566,896 (1957) shows a mechanical plunger and peg arrangement for actuating an alarm bell at a preset time set on a wrist watch held on a stand.

U.S. Pat. No. 1,261,411 to Lewchuk, issued Apr. 2, 1917, relates to a remote alarm arrangement including a time piece having a strap for wearing on a person's wrist. Also of interest are U.S. Pat. Nos. 1,361,413 to Stenberg which issued Dec. 7, 1920 and 1,529,852 to Tanglin which issued Feb. 21, 1924. None of the prior art references disclose the specific arrangement proposed by this invention wherein a remote alarm is activated by RF, magnetic or optical signals generated by a wrist watch nor do they disclose the particular alarm box which also serves as a stand for the watch.

SUMMARY OF THE INVENTION

The present invention relates to a new and improved alarm-actuating watch having a remote sonic generator. The preferred embodiment of the invention comprises a wrist watch including a quartz crystal controlled time base, frequency divider and counter circuits, a time display having no moveable elements coupled to the counters by an appropriate decoder, and an energy cell or battery to power the system. The watch also contains appropriate setting circuitry to set the display to the correct time and an adjustable storage register into which the desired alarm time can be entered. Switching means are provided to display the alarm "set" time in lieu of the continuous time display. Finally, the watch contains comparator means generating predetermined signals when the real time coincides with the alarm time stored in the register. An example of the foregoing type of electronic alarm wristwatch is disclosed in detail in U.S. Pat. No. 3,946,549 issued Mar. 30, 1976 to Arthur Cake, which is incorporated herein by reference. In that patent an alarm, such as a buzzer is controlled by an alarm logic circuit when the settings of registers 12, 14 coincide.

The remote sonic generator comprises a housing which is designed to serve as a stand for the wristwatch so that it can be readily viewed. The generator also includes within the housing a comparatively large and powerful battery, a sound generator and a sensor adapted to pick up a signal from the wristwatch at the alarm time. The sonic generator may be either a conventional buzzer, a piezoelectric sound generator or a small loudspeaker or similar device. The watch is mounted in the stand so that the sensor readily picks up alarm signals from the adjacent watch.

Accordingly, an object of this invention is to provide a new and improved alarm watch having a remote sonic generator.

A further object of this invention is to provide a new and improved alarm actuating watch having a remote sonic generator activated by signals from the wristwatch at a predetermined time.

A more specific object of this invention is to provide a new and improved alarm watch wherein the alarm is located in a separate stand which holds the watch when the alarm feature is in use, said alarm being activated at a predetermined time by signals from the watch.

BRIEF DESCRIPTION OF THE DRAWINGS

Other objects and advantages may be seen from the following description viewed in conjunction with the accompanying drawing wherein.

DETAILED DESCRIPTION OF THE DRAWINGS

Figure 1:
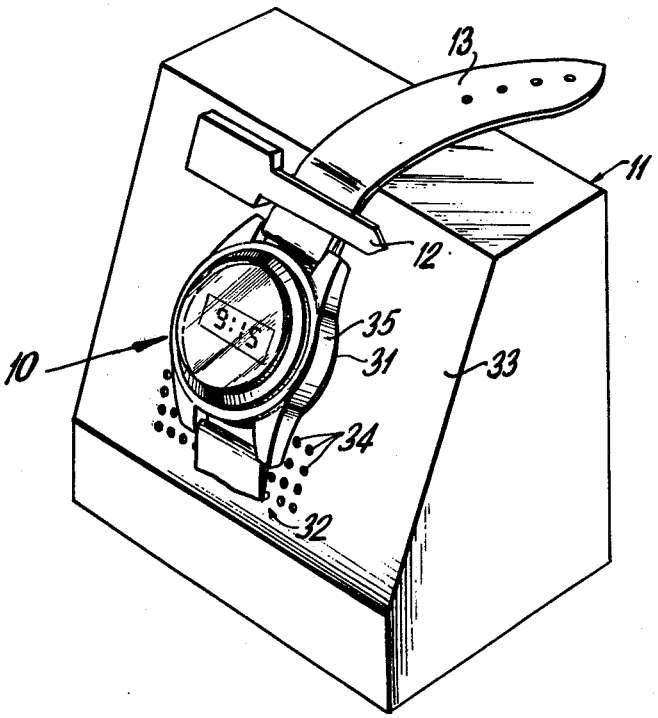
FIG. 1 is a perspective view of the alarm wrist watch mounted in the alarm stand.
Figure 2:
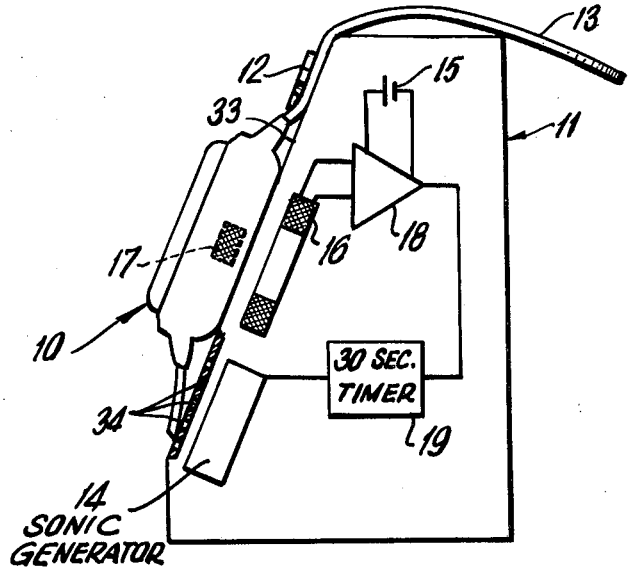
FIG. 2 is a schematic view of the alarm watch mounted in the alarm stand showing an embodiment wherein RF signals are utilized to activate the alarm.

Referring now to FIGS. 1 and 2 of the drawings, the invention comprises an electronic alarm actuating watch 10 and alarm box 11. When the alarm feature is in use, the watch 10 is mounted on the alarm box 11 by suitable means such as the spring-loaded tong 12 which grips the watch strap 13. The alarm watch 10 is positioned with its caseback 31 above a perforated portion 32 of the sloping face 33 on the alarm box 11 so that it is readily visible to the user. Sound signals are transmitted from the interior of the box 11 through the perforations 34.

Referring to FIG. 2 of the drawings, the alarm box 11 contains a sonic generator 14 which is sufficiently loud for most functional purposes and a relatively large power supply battery 15. Since the sonic generator 14 and associated power supply 15 are separate from the watch 10, the watch construction permits the use of a relatively thin case 35. Thus, with the present invention it is possible to have a thin electronic watch which causes an audible signal to be emitted at an adjustable predetermined time.

It is, of course, recognized that the watch 10 when worn on the user's wrist is not capable of functioning as an alarm watch, but in most cases, this is not important since the alarm is generally used in the morning. At this time, the user does not customarily wear his watch having placed it on a night table or convenient resting place. The alarm box 11 provides such a resting place and holds the watch in position on the face 33 so that the time display can be readily seen by the user.

A typical solid state wrist watch 10 of a type well known in the art contains a quartz crystal-controlled time base, a frequency divider, counter circuits, a time display having no moveable elements coupled to the counters by an appropriate decoder and an energy cell to power the system. Furthermore, the watch contains appropriate setting circuitry to set the display to the correct time and an adjustable storage register into which the desired alarm time can be entered and switching means to display this time in lieu of the real continuous time display. Finally, the watch 10 contains comparator means generating an electric signal when the real time coincides with the alarm time stored in the register as fully described in the aforementioned U.S. Pat. No. 3,946,549. All of these elements and their functioning are well known in the art and hence are not shown or described in detail herein.

The sonic generator 14 in the alarm box 11 may be either a conventional buzzer, a piezoelectric sound generator or a small loud speaker or similar device. The last mentioned devices are excited from an audio oscillator in the alarm housing.

Figure 6:
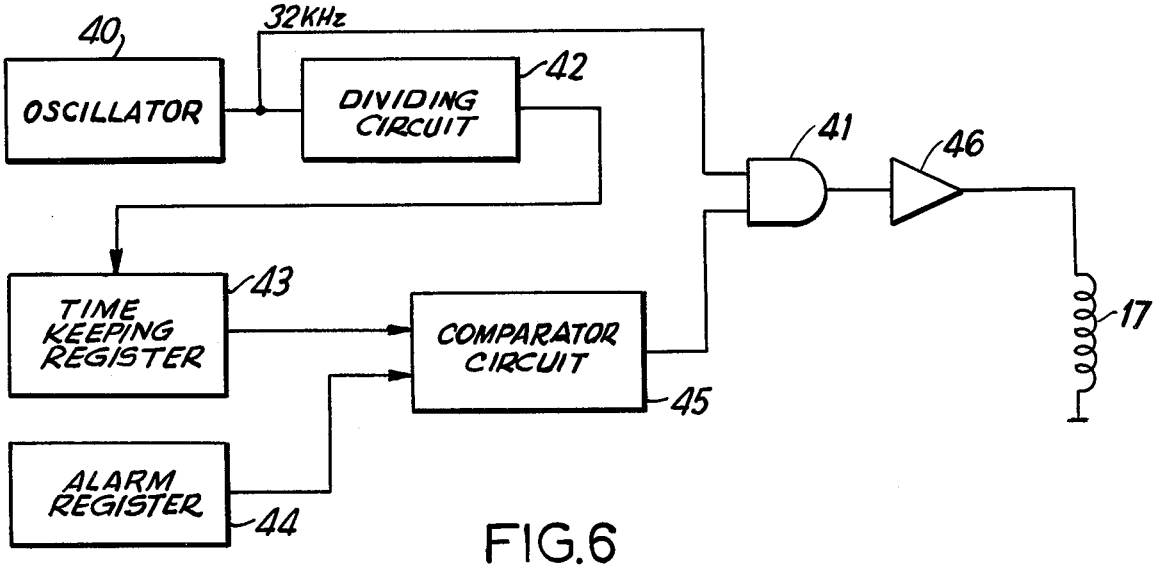
FIGS. 6, 7 and 8 are schematic views of an RF coupling circuit, a magnetic coupling circuit and an optical coupling circuit respectively.

The alarm system within the box 11 comprises a coil 16 serving as an antenna or sensor adapted to receive radio frequency signals emitted by the watch 10 when placed upon the stand. The watch 10 contains a much smaller coil 17 which is excited by a radio frequency signal for a fraction of a second at the time for which the alarm is set. FIG. 6 is a schematic view showing the RF coupling signal generator. This signal is obtained by power amplification of the quartz crystal oscillator frequency in the order of 32,768 Hz, which is a conventional frequency used in commercial watch circuits. The high frequency signal from a quartz crystal oscillator 40 is connected as one input of an AND gate 41. Oscillator 40 feeds a divider 42 providing 1 Hz pulses to a time keeping register 43. The output of time register 43 is compared with the selected alarm time from alarm register 44 by a comparator circuit 45. The output of the comparator circuit 45 is connected as the other input to AND gate 41. Upon reaching the preselected time, the output from AND gate 41 provides an amplified RF signal to coil 17 which in turn emits an RF coupling signal.

The coil 16 in the alarm stand 11 is tuned to the radio frequency emitted by coil 17, eliminating the risk of erroneous alarm activation by spurious signals. The coil 16 in the alarm picks up the RF signal from the watch 10. The signal is amplified in the amplifier 18 and closes an electronic switch (not shown) to energize the sonic generator 14. The sonic generator remains energized after cessation of the RF signal until shut off manually or by means described hereafter.

The alarm system may also contain a timing device 19 coupled between the amplifier 18 and the generator 14 which turns off the generator 14 after a suitable time interval. In a typical design, the timer 19 turns off the generator 14 after one-half to one minute and then turns it on again five or ten minutes later unless a manual switch (not shown) is depressed. Similar arrangements are known in the industry as a "snooze alarm".

Figure 3:
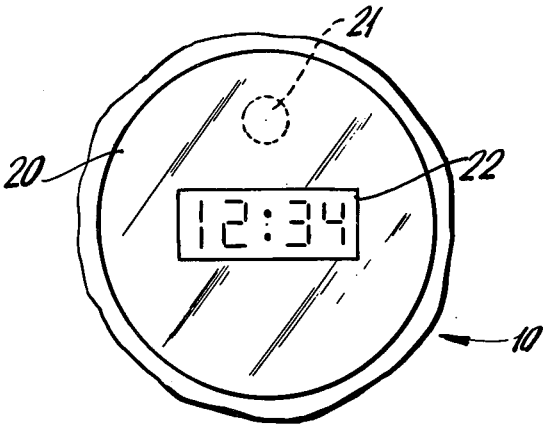
FIG. 3 is a front view of the dial face of a liquid crystal embodiment of the alarm watch wherein optical signals are utilized to activate the alarm.
Figure 4:
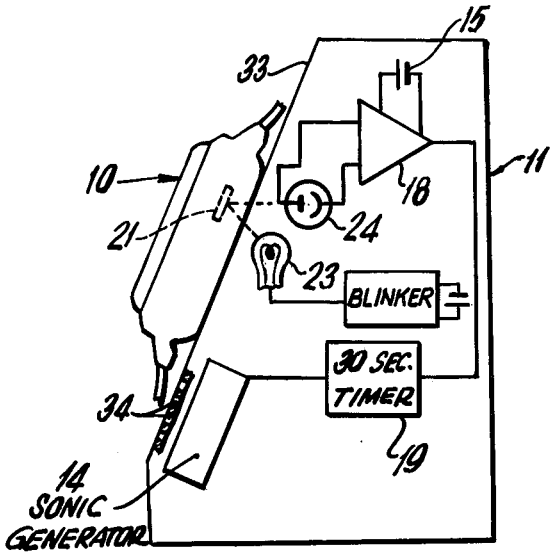
FIG. 4 is a schematic view of the liquid crystal embodiment mounted in the watch stand.

A further embodiment of the invention is shown in FIGS. 3 and 4 utilizing optical means for coupling between the wrist watch 10 and alarm box 11. In this arrangement, the watch dial face 20 carries a small liquid crystal cell 21 of ⅛" diameter which is normally reflecting specularly but assumes a cloudy appearance when electrically excited. Alternately, the cell 21 which is positioned above the display 22 appears light when not excited and appears dark when excited. The change in appearance takes place at the time when the alarm is activated, by activating the liquid crystal cell in a known manner to provide an optical coupling signal.

Figure 7:
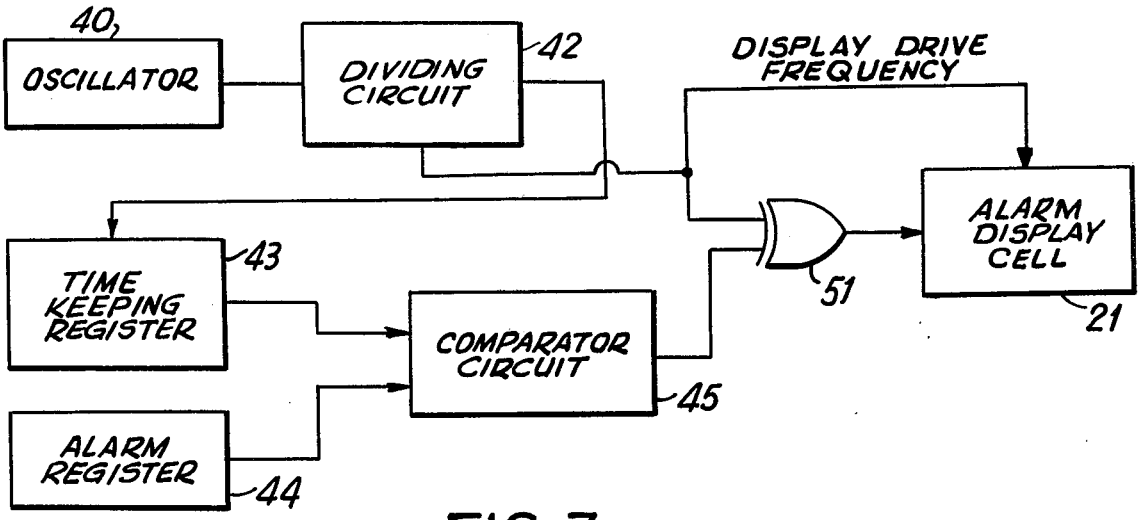

FIG. 7 shows a suitable circuit for activating the alarm display cell 21. The oscillator 40, dividing circuit 42, time keeping register 43, alarm register 44 and comparator 45 are the same as in FIG. 6. Typically the time display (not shown) of the liquid crystal type is modulated at a frequency such as 32 Hz, and is activated or not, depending upon whether the square wave voltages, connected both to the display segment and to the display common, are in or out of phase. In FIG. 6 this display modulation signal is connected to the common of the alarm display cell 21 and also to the input of an exclusive OR gate 51. The output from comparator 45 is connected as the other input to OR 51. An alarm signal from comparator 45 causes the signals applied to cell 21 to be out of phase and to activate the cell to darken it. This provides an optical coupling signal which may be detected by the sensor in the alarm box.

The alarm box 11 of FIG. 4 includes a light source 23 such as a light emitting diode which is focused by optical means on the liquid crystal cell 21. A photocell or similar light detector 24 is arranged to sense the optical coupling signal provided by the liquid crystal cell 21 and generates an output signal, which after amplification in the amplifier 18, is capable of activating the sonic alarm 14. The light source 23 is actuated by a blinker and interrogates the status of the liquid crystal 21 periodically, preferably at one minute intervals, to economize on power consumption. The interrogation consists of a series of light pulses which must be received by the photocell 21 in proper sequence to generate the alarm actuating signal. This arrangement minimizes risk of accidental actuation of the alarm.

In this last embodiment, the liquid crystal cell 21 is arranged behind a small hole in the case back of the watch which allows the optical signal to pass. The watch is mounted with its back towards the alarm box, and the dial face is visible to the user.

Figure 5:
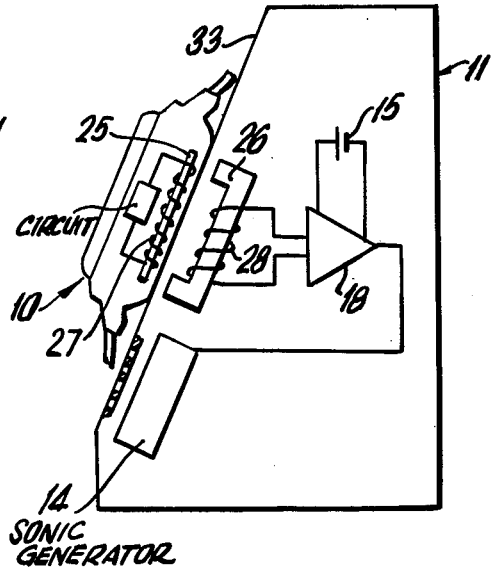
FIG. 5 is a schematic view of an embodiment wherein magnetic signals are utilized to activate the alarm in the alarm stand.

FIG. 5 illustrates another embodiment of the invention wherein the watch 10 and alarm stand 11 are coupled by a magnetic core arrangement. One core 25 is in the wristwatch 10 and the other core 26 of U-shape is in the alarm box 11. When the watch is placed on the alarm box 11, the adjacent ends of the respective cores 25 and 26 form a closed magnetic circuit. A coil 27 is wound around the core 25 in the watch 10 and another coil 28 is wound around the core 26 in the alarm stand 11. At the preset alarm time, a current pulse is sent through the coil 27 in the watch 10 and the magnetic coupling then generates a pulse in the coil 28 in the alarm box 11 thus activating the alarm in the manner previously described.

Figure 8:
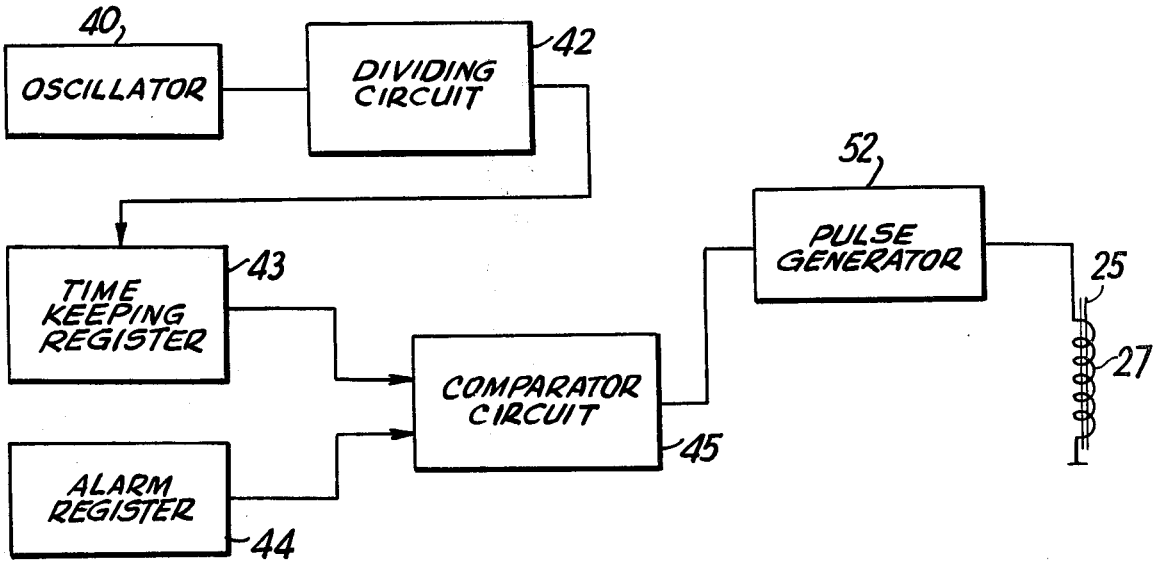

FIG. 8 shows a suitable circuit for providing the magnetic coupling signal by actuating coil 27. An oscillator 40, dividing circuit 42, timekeeping register 43, alarm register 44 and comparator 45 are provided as before. The output of the comparator is connected to a pulse generator 52 which is a single-shot multivibrator serving to drive a current pulse through the coil 27. This provides the magnetic coupling signal to activate the sensor and sonic generator in the alarm box 11.

While the invention has been explained by a detailed description of certain specific embodiments, it is understood that various modifications and substitutions can be made in any of them within the scope of the appended claims which are intended also to include equivalents of such embodiments.

I claim:

1. An alarm device comprising:

a watch having alarm logic circuit means for electrically generating alarm coupling signals at a selectable time, a stand adapted to temporarily hold the watch in proximity thereto, sensing means mounted in said stand physically separated from said watch when the watch is held on the stand but responsive to said signals, and a sonic generator coupled to the sensing means and being activated by said signals to produce an audible sound.

2. An alarm device in accordance with claim 1 wherein:

the stand comprises an alarm box having a base and a top joined by four walls, one of said walls having at least a portion thereof sloping at an angle from the top to provide a readily viewable surface for the watch, and means for mounting the alarm watch on said sloping wall.

3. An alarm device in accordance with claim 2 wherein:

the stand further includes a perforated portion on one of the walls wherefrom the alarm sound emanates, the sonic generator being mounted within the stand adjacent said perforated portion, and an elongated spring member mounted at one end to the sloping wall and extending transversely at a set distance above said wall to grip a watch band connected to the alarm watch.

4. An alarm device in accordance with claim 1 wherein:

the stand further includes means for mounting the watch thereon to be easily visible, and amplifier means connected between the sensing means and the sonic generator to provide an activating signal to said generator.

5. An alarm device in accordance with claim 4 wherein:

the stand further includes timing means connected between the amplifier and the sonic generator for turning off the sonic generator after a predetermined period of activation and then turning on after a second predetermined period of time to provide a snooze alarm effect.

6. An alarm device comprising:

a watch having alarm logic circuit for electrically generating alarm coupling signals at a selectable time, comprising a first coil mounted within the watch with means for exciting the coil at radio frequency at a preset time to generate alarm signals, a stand adapted to temporarily hold the watch in proximity thereto, sensing means mounted in said stand physically separated from said watch when the watch is held on the stand but responsive to said signals comprising a second coil tuned to receive radio frequency alarm coupling signals from the first coil, and a sonic generator coupled to the sensing means and being activated by said signals to produce an audible sound.

7. An alarm device comprising:

a watch having alarm logic circuit for electrically generating alarm coupling signals at a selectable time, comprising a liquid crystal cell mounted in the watch, said cell being normally of light appearance with means for electrically exciting said cell to cause it to darken at the preset alarm time, a stand adapted to temporarily hold the watch in proximity thereto, sensing means mounted in said stand physically separated from said watch when the watch is held on the stand but responsive to said signals including a light source focused on the liquid crystal cell and a light detector arranged to receive light coming from the liquid crystal cell, said light source periodically interrogating the liquid crystal cell with a series of light pulses so that signals from said cell activate the light detector to produce an alarm generating signal if received in a predetermined sequence, and a sonic generator coupled to the sensing means and being activated by said signals to produce an audible sound.

8. An alarm device comprising:

a watch having alarm logic circuit means for electrically generating alarm coupling signals at a selectable time comprising a first magnetic core having a first coil wound thereabout and means for feeding a current pulse through said coil at the preset alarm time, a stand adapted to temporarily hold the watch in proximity thereto, sensing means mounted in said stand physically separated from said watch when the watch is held on the stand but responsive to said signals, comprising a second magnetic core of a substantially U-shape mounted with the legs of the "U" adjacent the first core, said core having a second coil wound thereabout so that the magnetic coupling between the first and second cores produces a pulse in the second coil when a current pulse is fed to the first coil, and a sonic generator coupled to the sensing means and being activated by said signals to produce an audible sound.

* * * * *